US009785164B2

(12) United States Patent
Aboudina et al.

(10) Patent No.: US 9,785,164 B2
(45) Date of Patent: Oct. 10, 2017

(54) POWER SUPPLY REJECTION FOR VOLTAGE REGULATORS USING A PASSIVE FEED-FORWARD NETWORK

(71) Applicant: Vidatronic, Inc., College Station, TX (US)

(72) Inventors: Mohamed Mostafa Saber Aboudina, Giza (EG); Sameh Ahmed Assem Mostafa Ibrahim, Cairo (EG); Mohamed Ahmed Mohamed El-Nozahi, Heliopolis (EG); Faisal Abdellatif Elseddeek Ali Hussien, Cairo (EG)

(73) Assignee: Vidatronic, Inc., College Station, TX (US)

( * ) Notice: Subject to any disclaimer, the term of this patent is extended or adjusted under 35 U.S.C. 154(b) by 0 days.

(21) Appl. No.: 14/989,645

(22) Filed: Jan. 6, 2016

(65) Prior Publication Data

US 2016/0195883 A1 Jul. 7, 2016

Related U.S. Application Data

(60) Provisional application No. 62/100,393, filed on Jan. 6, 2015.

(51) Int. Cl.
*G05F 1/575* (2006.01)

(52) U.S. Cl.
CPC ..... *G05F 1/575* (2013.01)

(58) Field of Classification Search
CPC ... G05F 1/10; G05F 1/46; G05F 1/461; G05F 1/462; G05F 1/468; G05F 1/56; G05F 1/562; G05F 1/563; G05F 1/565; G05F 1/575; G05F 1/59; H02M 3/156; H02M 3/1563; H02M 3/1566; H02M 3/157; H02M 3/158; H02M 2001/0016; H02M 2001/0025; H02M 2001/0045; H02M 2001/0022
USPC ..... 323/222–226, 266, 271–277, 280–286, 323/299–303, 351; 363/39, 45–47; 327/538–543, 551–559
See application file for complete search history.

(56) References Cited

U.S. PATENT DOCUMENTS

2007/0216381 A1* 9/2007 Tsuchiya ..... G05F 1/575 323/273
2013/0222075 A1* 8/2013 Reedy ..... H03J 3/20 333/32

OTHER PUBLICATIONS

El-Nozahi et al. (M. El-Nozahi et al., "High PSR Low Drop-Out Regulator with Feed-Forward Ripple Cancellation Technique", IEEE, vol. 45, No. 3, Mar. 2010, pp. 565-577.*
M. El-Nozahi et al., "A 25mA 0.13μm CMOS LDO Regulator with Power-Supply Rejection Better Than -56dB up to 10MHz Using a Feedforward Ripple-Cancellation Technique", IEEE, 2009, pp. 330-332.*

* cited by examiner

*Primary Examiner* — Timothy J Dole
*Assistant Examiner* — Carlos Rivera-Perez
(74) *Attorney, Agent, or Firm* — Osha Liang LLP

(57) ABSTRACT

A low drop-out (LDO)/load switch linear voltage regulator (LVR) circuit having a first input terminal and a first output terminal, includes: a passive network with a second input terminal connected to the first input terminal and a second output terminal; a feedback network with a third input terminal connected to the first output terminal and a third output terminal; a pass element having a fourth input terminal connected to the first input terminal, a fourth output terminal connected to the first output terminal and first control terminal; a combiner having a fifth input connected to the second input, a sixth input connected to the third output and a fifth output connected to the first control terminal.

9 Claims, 8 Drawing Sheets

POWER SUPPLY REJECTION FOR VOLTAGE REGULATORS USING A PASSIVE FEED-FORWARD NETWORK

CROSS REFERENCE TO RELATED APPLICATIONS

This claims the priority of U.S. Provisional Patent Application No. 62/100,393, filed on Jan. 6, 2015, the disclosure of which is incorporated by reference in its entirety.

BACKGROUND

FIG. 1 shows a schematic block diagram of a prior art linear voltage regulator (100) with high power supply rejection (PSR). As shown in FIG. 1, the feedback network (106), including a resistor divider, an error amplifier (112) and an optional extra amplifier (113), regulates the DC output voltage $V_{out}$ (102) to a desired level given by: $V_{out}=V_{ref}*(1+R_2/R_1)$. The resistor $R_2$ may be a short circuit, and the resistor $R_1$ may be an open circuit in some implementations. The pass transistor $M_{pass}$ (103) may be a field effect transistor (FET), a bipolar transistor, an LDMOS transistor or a FinFET device, and $M_{pass}$ may be of either n-type or p-type. High-gain amplifiers are typically used as the implementation of the error amplifier (112) in the feedback network (106). The second stage of the feedback network (106) is optional and might provide gain higher than 1 or be used as a buffer stage to drive the pass transistor (103). The feed-forward block (105) is used to enhance the power supply rejection of the linear voltage regulator (100). Linear voltage regulator architectures are generally categorized into two main categories: Voltage regulators that require an external capacitor for compensation and voltage regulators that do not require an external capacitor for compensation. This last category is named "cap-less linear voltage regulators". The compensation capacitor whether internal or external is not shown in FIG. 1 (100). Power supply rejection (PSR) is the ability of the voltage regulator to reject any noise coming from the supply through the $V_{in}$ terminal in FIG. 1. Throughout this disclosure, the terms, "power supply," "supply," "$V_{in}$," and "$V_{in}$ terminal" may be used interchangeably to refer to the power source input to a voltage regulator.

One of the main features of linear voltage regulators (LVRs) is their good power supply rejection (PSR). At low frequencies, the PSR is dominated by the DC gain of the loop. At high frequencies, due to bandwidth limitations of the error amplifier, the PSR of the LVR suffers. A brute force technique to keep a high PSR would be to compromise between power consumption and the PSR. However, this is not a favorable strategy.

One of the techniques to improve power supply rejection in LVRs is to use a feed-forward (FF) block (105) through a FF path (110) to sense the input supply variations and cancel it at the output of the LVR. The FF block (105) consists of an active filter to equalize the input ripples to match the frequency response of the Direct Path (109). The adder (116) combines the direct path (109) and the FF path (110) to cancel the effect of the input ripples coming from the direct path. This technique improves the PSR dramatically at high frequencies.

The FF block (105) typically consists of active filters to shape the frequency content of the input ripples to match that of the direct path (109). These active filters serve also to boost the DC gain of the FF signal to match the DC gain of the direct path. The FF block consumes extra power consumption that increases the quiescent power consumption of the overall LVR.

Using a feed-forward (FF) cancellation path to reduce the effect of the input supply ripples has been proposed before, see El-Nozahi et al., "*High PSR low drop-out regulator with feed-forward ripple cancellation technique*," Solid-State Circuits, IEEE Journal, Vol. 45, no. 3 (2010): pp. 565-577. The technique disclosed in this paper uses an FF cancellation path that involves an active filter. The power consumption of the active filter is proportional to the frequency range to be covered by the FF block. The technique was introduced for a low drop-out (LDO) linear voltage regulator (LVR) that uses an external capacitor for stability purposes.

In U.S. Patent Application Publication No. 2012/0212199 A1, by Amer et al., an input FF cancellation technique was disclosed that works with cap-less LDOs. The FF block is also active and hence consumes extra power.

While these prior art approaches provide useful improved power supply rejection for voltage regulators, there is still a need for better approaches.

SUMMARY OF THE INVENTION

Embodiments of the invention relate to the use of FF techniques for power supply rejection in voltage regulators. Embodiments of the invention are based on a passive FF network. This will improve the PSR at high frequencies with a negligible increase in power consumption.

Non-idealities from parasitic capacitances and resistances of an LDO circuit affect and limit the LDO power supply rejection. One of the non-idealities is intrinsic parasitics of a pass transistor (for example, the output impedance is not infinite).

Feed-forward techniques using an active filter to cancel the main path for input noise to couple to the output voltage can increase the power consumption of the control loop.

Embodiments of the invention present an ultra-low-power feed-forward technique that improves the PSR of linear voltage regulators at high frequencies without using active circuits. It relies only on a passive feed-forward filter in order to cancel the effects of supply variations at the output.

One aspect of the invention relates to low drop-out (LDO)/load switch linear voltage regulator (LVR) circuits. An LVR circuit in accordance with one embodiment of the invention has a first input terminal and a first output terminal and includes: a passive network with a second input terminal connected to the first input terminal and a second output terminal; a feedback network with a third input terminal connected to the first output terminal and a third output terminal; a pass element having a fourth input terminal connected to the first input terminal, a fourth output terminal connected to the first output terminal and first control terminal; a combiner having a fifth input connected to the second input, a sixth input connected to the third output and a fifth output connected to the first control terminal.

In accordance with some embodiments of the invention, the passive network scaling factor may be frequency dependent.

In accordance with some embodiments of the invention, the pass element can be an n-type or a p-type device.

In accordance with some embodiments of the invention, the pass element comprises at least one selected from a group consisting of a field effect transistor, a bipolar junction transistor, an LDMOS and a FinFET device.

In accordance with some embodiments of the invention, the combiner combines either voltages or currents.

In accordance with some embodiments of the invention, the passive network includes at least one selected from a group consisting of resistive components, capacitive components and inductive components. The values of the components are either fixed or input dependent In accordance with some embodiments of the invention, resistive components are implemented using at least one element selected from a group consisting of a physical resistor and a transistor behaving as a resistor.

In accordance with some embodiments of the invention, capacitive components are implemented using at least one element selected from a group consisting of a physical capacitor and a transistor operating as a capacitor.

Another aspect of the invention relate to methods for achieving good power supply rejection (PSR) of a low drop-out (LDO)/load switch linear voltage regulator (LVR) having a passive network. A method in accordance with one embodiment of the invention includes the steps of sensing the ripples from the input; scaling the ripples using the passive network; and injecting the output of the passive network to the original LVR. The scaling is either fixed or input dependent.

BRIEF DESCRIPTION OF DRAWINGS

The appended drawings illustrate several embodiments of the invention and are not to be considered limiting of its scope, for the invention may admit to other equally effective embodiments.

DETAILED DESCRIPTION

Figure 1:
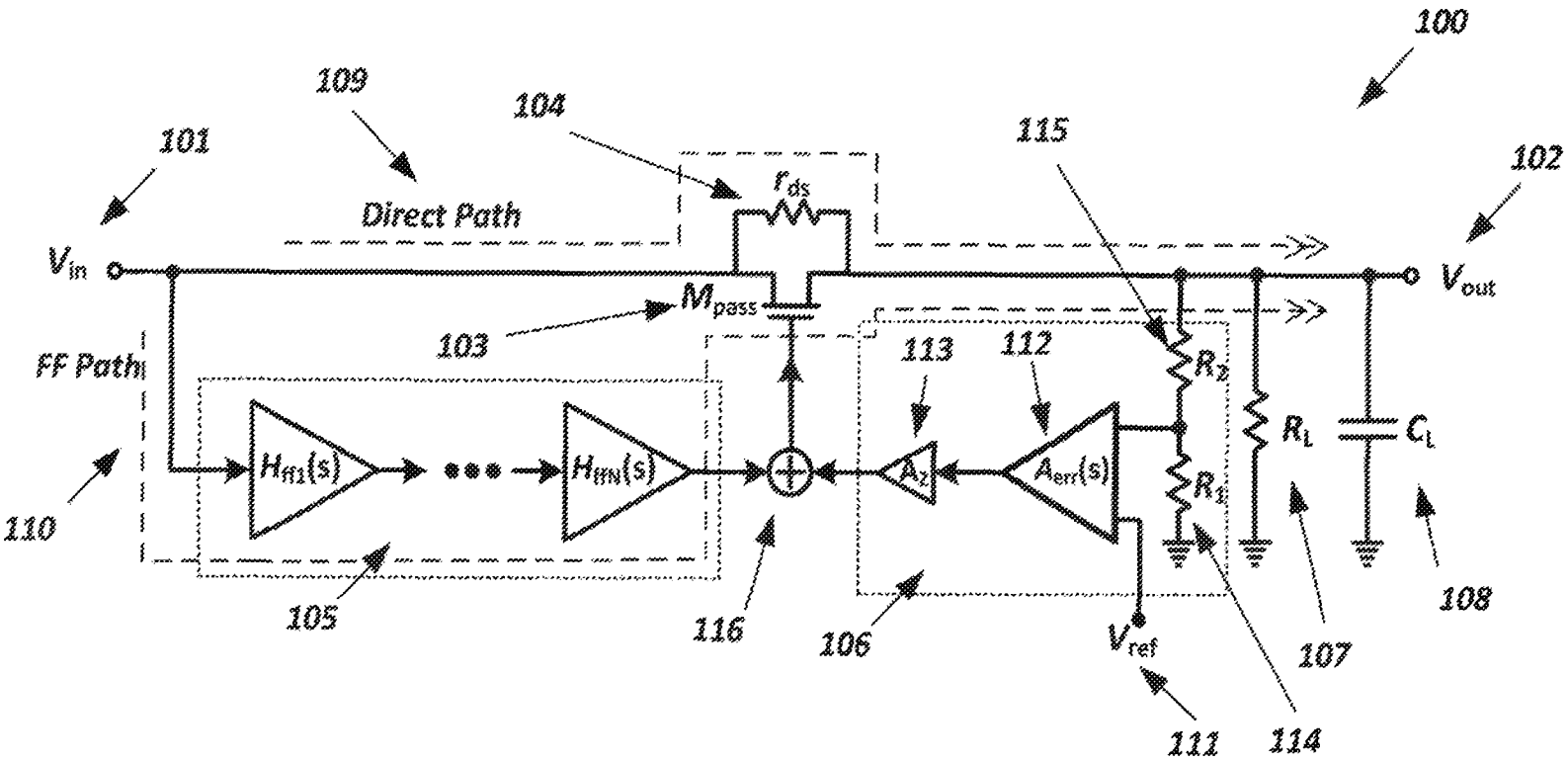
FIG. 1 (PRIOR ART)
FIG. 1 shows a generic block diagram of a prior art linear voltage regulator that includes a feed-forward cancellation path.

Embodiments of the present invention are illustrated in the above-identified drawings and are described below. In the following description, like or identical reference numerals are used to identify common or similar elements. The drawings are not necessarily to scale and certain features may be shown exaggerated in scale or in schematic in the interest of clarity and conciseness.

Embodiments of the invention can improve the power supply rejections using extra passive circuits for linear voltage regulators, whether capless (i.e., without a capacitor) or with external capacitors, and for all types of pass transistors. Those skilled in the art, with the benefit of this disclosure, will appreciate that the inventive passive feed-forward (FF) circuits may also be used in other types of voltage regulator circuits. That is, one skilled in that art would appreciate that other modifications or variations of the specific examples disclosed herein are possible without departing from the scope of the invention.

FIG. 1 shows a generic block diagram for a prior art linear voltage regulator with a feed-forward (FF) cancellation path where the input $V_{in}$ (101) is the power supply of the circuit and the output $V_{out}$ (102) might drive both a resistive load $R_L$ (107) and/or a capacitive load $C_L$(108). The pass transistor (103) can be a MOSFET device, a bipolar device, an LDMOS device or a FinFET device, and it can be either a p-type or an n-type device. The regulation is performed by a feedback network (106) that consists of a voltage divider, e.g. combination of $R_1$ (114) and $R_2$ (115), followed by an error amplifier (112), which regulates the output using the reference signal $V_{ref}$ (111). The second stage $A_2$ (113) of the feedback network can either provide gain or attenuation and can be used as a buffer to the pass transistor (103) or can be eliminated altogether.

In prior art, the feed-forward (FF) block (105) shown in FIG. 1 is implemented using active components, which require quiescent current for proper operations. This, in turn, increases the quiescent power consumption of the linear voltage regulator (LVR).

Figure 2:
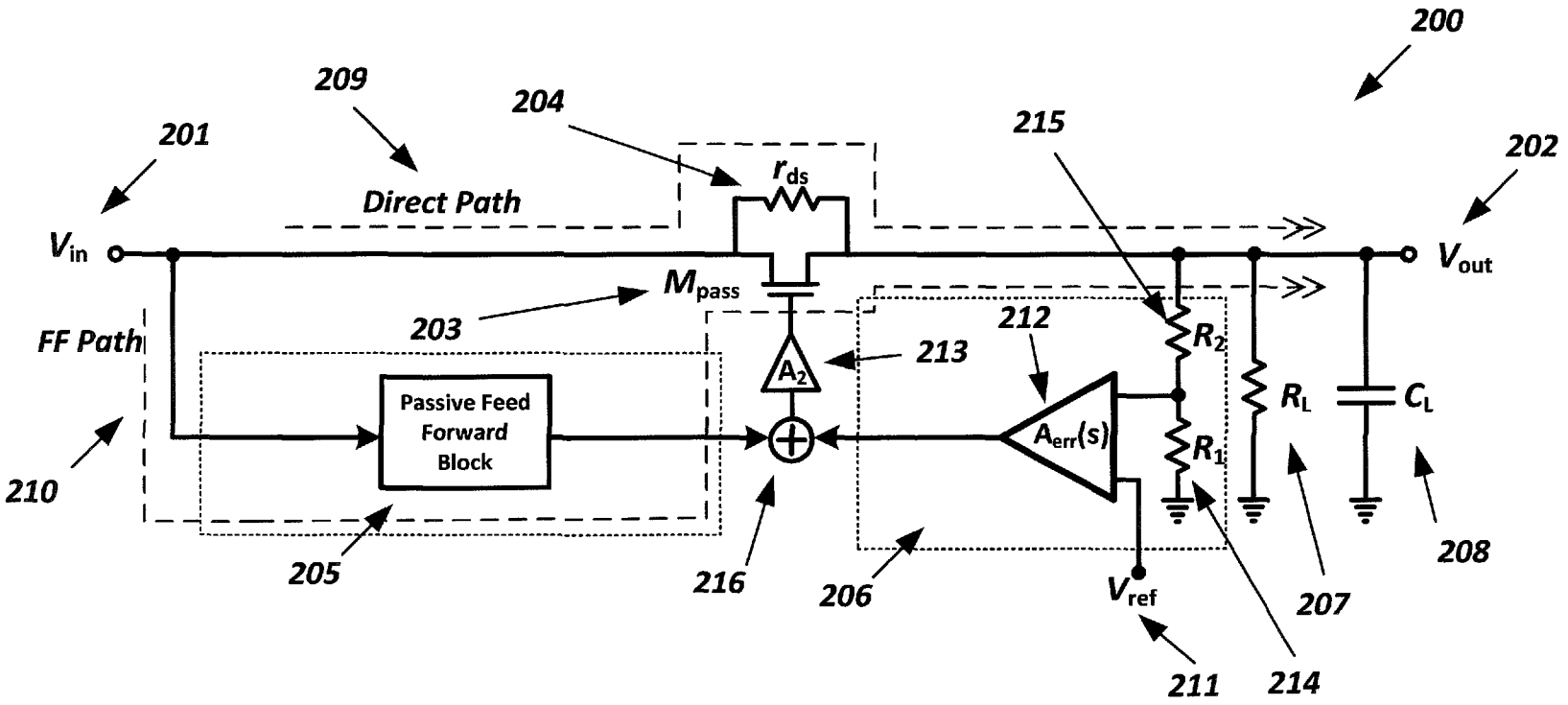
FIG. 2 shows a modified linear voltage regulator suitable for p-channel pass transistors in accordance with one embodiment of the invention.

FIG. 2 shows a schematic of a modified linear voltage regulator (LVR) (200) in accordance with one embodiment of the invention. As shown in FIG. 2, LVR (200) uses a passive FF block (205), wherein an input supply (201) is applied to the circuit and an output (202) is obtained from the LVR (200). The output may drive a resistive load $R_L$ (207) and/or a capacitive load $C_L$(208). In FIG. 2, the LVR (200) includes a pass transistor (203) and an output resistance (204). A feedback network (206) is used for regulating the output voltage relative to a reference voltage (211).

As shown in FIG. 2, the feedback network (206) consists of a voltage divider $R_1$ (214) and $R_2$ (215), an error amplifier (212), and an optional output stage (213). A ripple direct path (209) would not go through the FF block (205), while a FF ripple elimination path (210) would go through the passive FF block (205). An adder (216) sums the FF path output to the output of the error amplifier (212). That is, the output of the passive feed-forward block (205) is added to the output of the error amplifier (212), and then the sum is fed into the gain stage ($A_2$) (213).

In accordance with one or more embodiments of the invention, the FF block (205) is based on a passive circuit.

In accordance with embodiments of the invention, the FF block (205) can be built on the same chip as the voltage regulator (200), on a different chip, or off chip.

Figure 3:
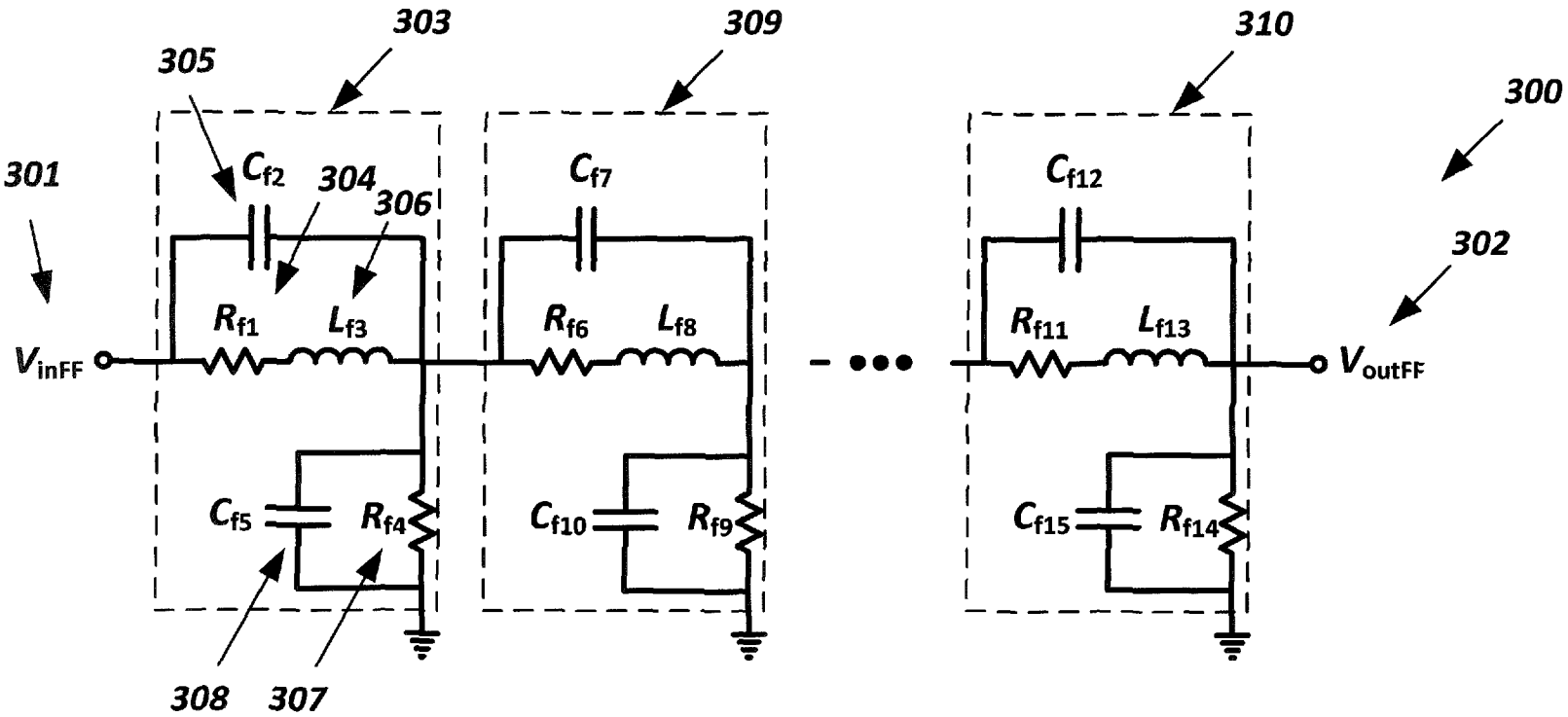
FIG. 3 shows an example of a passive feed forward block in accordance with one embodiment of the invention.

FIG. 3 shows a schematic illustrating an example of a passive implementation of the FF block (205). As shown in FIG. 3, the circuit (300) shows an example for a FF circuit based on passive components only. An input of the FF block (301) is s also the input supply of the linear regulator (100), and the output of the FF block, $V_{outFF}$, is shown as (302). A generic passive filter section (303) consists of passive components $R_{f1}$ (304), $C_{f2}$ (305), $L_{f3}$ (306), $R_{f4}$ (307) and $C_{f5}$ (308). Optional passive FF sections (309) and (310) may be used to create different poles and zeros in the FF transfer function. Some of these components inside (303), (309) and (310) can be either shorted or left open, depending on the required transfer function of the FF path, which will be described later. In addition, more passive components can be added to connect the outputs and inputs of different sections.

In one or more embodiments of the invention, the output of the passive FF block (205) may be injected between the error amplifier ($A_{err}(s)$) (212) and the second stage ($A_2$) (213) (as shown in FIG. 2).

The passive FF block (205) might include multiple inputs connected to input of the voltage regulator (201) and multiple outputs that are injected in the feedback network (206).

The transfer function of the direct path (209) from input (201) to output (202) is defined as $V_{out}(S)/V_{in}(S)$, assuming there are no supply ripples propagating through the FF path (210) and can be noted as $A_{DP}(s)$. The transfer function of the FF path (210) from input (201) to output (202) is defined as $V_{out}(s)/V_{in}(s)$ assuming there are no ripples propagating through the direct path (209) and can be noted as $A_{FFP}(s)$. For proper cancellation of the input ripples coming from the input (201) at the output, $A_{FFP}(s)$ must be chosen such that $A_{FFP}(s)=-A_{DP}(s)$. Which means that the magnitude of the two transfer functions are equal, e.g. $|A_{FFP}(j\omega)|=|A_{DP}(j\omega)|$, and the phase of the two transfer functions are 180 degrees out of phase, e.g. phase $(A_{FFP}(j\omega))=-$phase $(A_{DP}(j\omega))$.

The FF path transfer function $A_{FFP}(s)$ for the LVR in FIG. 2 can be expressed as a cascade of three transfer functions: the transfer function of the passive feed-forward block (205) ($A_{FF}(s)$), the gain of amplifier stage $A_2$ and the transfer function from the gate of the pass transistor ($V_G$) (217) to the output (202) ($A_{V_{G\text{-}hd\ out}}$). It can then be written as: $A_{FFP}(s)=A_{FF}(s)\times A_2\times A_{V_{G\text{-}hd\ out}}(s)$. Because the feed-forward block (205) is a linear passive circuit, it can only produce DC gains that are either one or less than one. Accordingly, the choice of whether to keep $A_2$ in the FF path or place it before the summer inside the feedback path must be made, taking into account the value of the direct path gain. This can be done as follows:

If $$\frac{|A_{DP}(0)|}{|A_{V_{G_{out}}}(0)|}$$

is greater than one, the gain stage $A_2$ (213) is kept as is in FIG. 2 such that:

$$|A_{FFP}(j\omega)| = |A_2(j\omega)|\times|A_{FF}(j\omega)|\times|A_{V_{G_{out}}}(j\omega)| = |A_{DP}(j\omega)| \text{ and } \text{phase}(A_{FFP}(\omega)) = \text{phase}(A_2(j\omega)) + \text{phase}(A_{FF}(j\omega)) + \text{phase}(A_{V_{G_{out}}}(j\omega)) = -\text{phase}(A_{DP}(j\omega)),$$

where $A_{FF}(s)$ is the transfer function of the passive feed-forward block (205). FIG. 2 is then used when the required $A_{DP}(s)$ has a magnitude greater than one. For example, when the pass transistor $M_{pass}$(203) is a p-type transistor.

Figure 4:
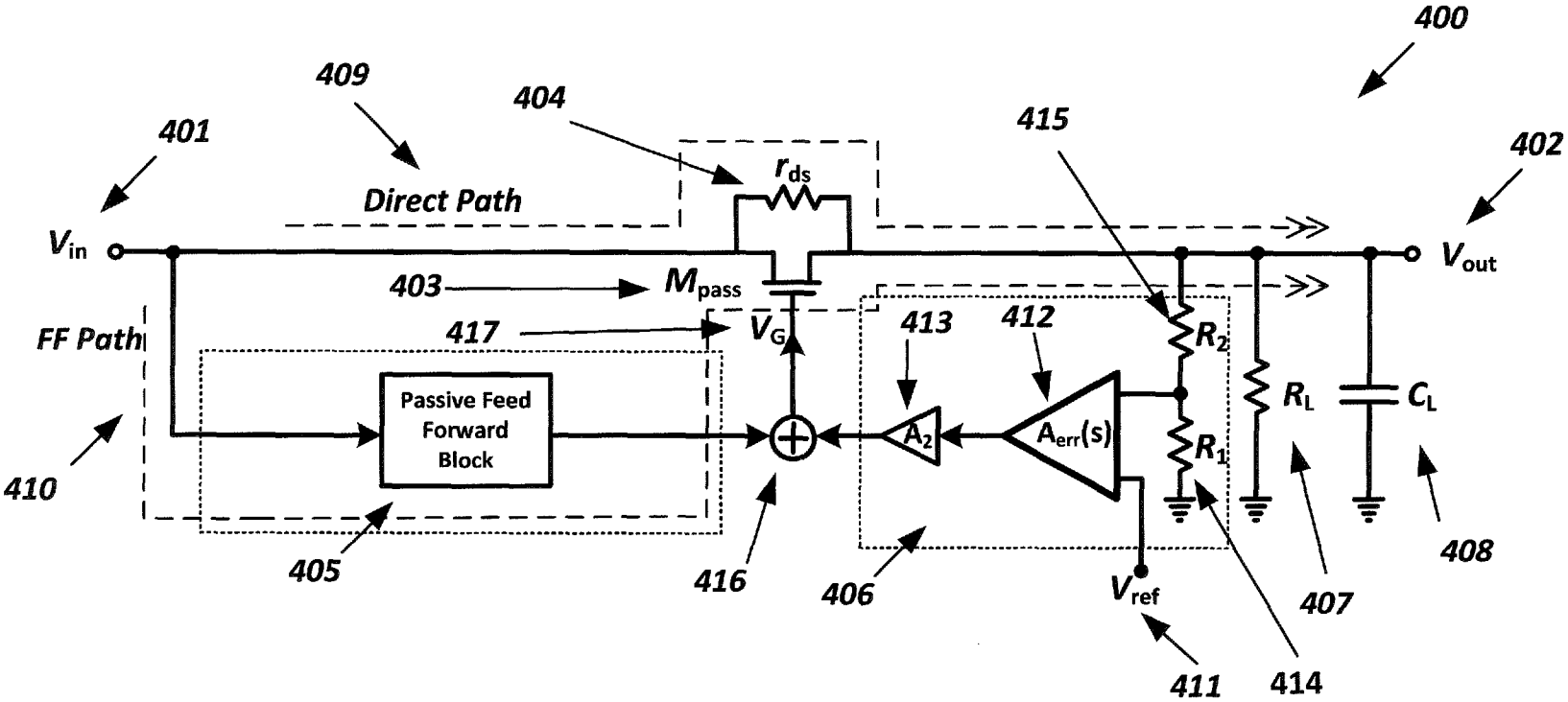
FIG. 4 shows a modified linear voltage regulator suitable for n-channel pass transistors in accordance with one embodiment of the invention.

If the $$\frac{|A_{DP}(0)|}{|A_{V_{G_{out}}}(0)|}$$

is less than one, then the implementation shown in FIG. 4 is used. In FIG. 4, (401) is the input supply to the circuit, (402) is the output of the voltage regulator, and (411) is the reference voltage. The output drives either a resistive load $R_L$ (407) and/or a capacitive load $C_L$ (408). (403) is the pass transistor and (404) is its output resistance. (406) is the feedback network used for voltage regulation, which consists of a voltage divider made by $R_1$ (414) and $R_2$ (415), the error amplifier (412) and the optional gain, buffer or attenuation stage (413). (409) is the ripple direct path and (410) is the feed-forward ripple elimination path. (405) is the passive feed-forward block. (416) is the adder that sums the feed-forward path output to the output of the feedback network. The optional gain, buffer or attenuation stage ($A_2$) (413) is placed before the adder in the feedback network (406) before the adder (416). The output of the adder $V_G$ (417) drives the pass transistor (403) gate. The transfer function from $V_G$ (417) to the output of the voltage regulator (402) is given by $A_{V_{G\text{-}out}}(s)$.

FIG. 4 is used when $$\frac{|A_{DP}(0)|}{|A_{V_{G_{out}}}(0)|}$$

is less than one, for example when the pass transistor (403) is an n-type transistor. Hence, the FF block (405) is designed such that:

$$|A_{FFP}(j\omega)| = |A_{FF}(j\omega)|\times|A_{V_{G-out}}(j\omega)| = |A_{DP}(j\omega)| \text{ and } \text{phase}(A_{FFP}(\omega)) = \text{phase}(A_{FF}(j\omega)) + \text{phase}(A_{V_{G-out}}(j\omega)) = -\text{phase}(A_{DP}(j\omega)).$$

Figure 5:
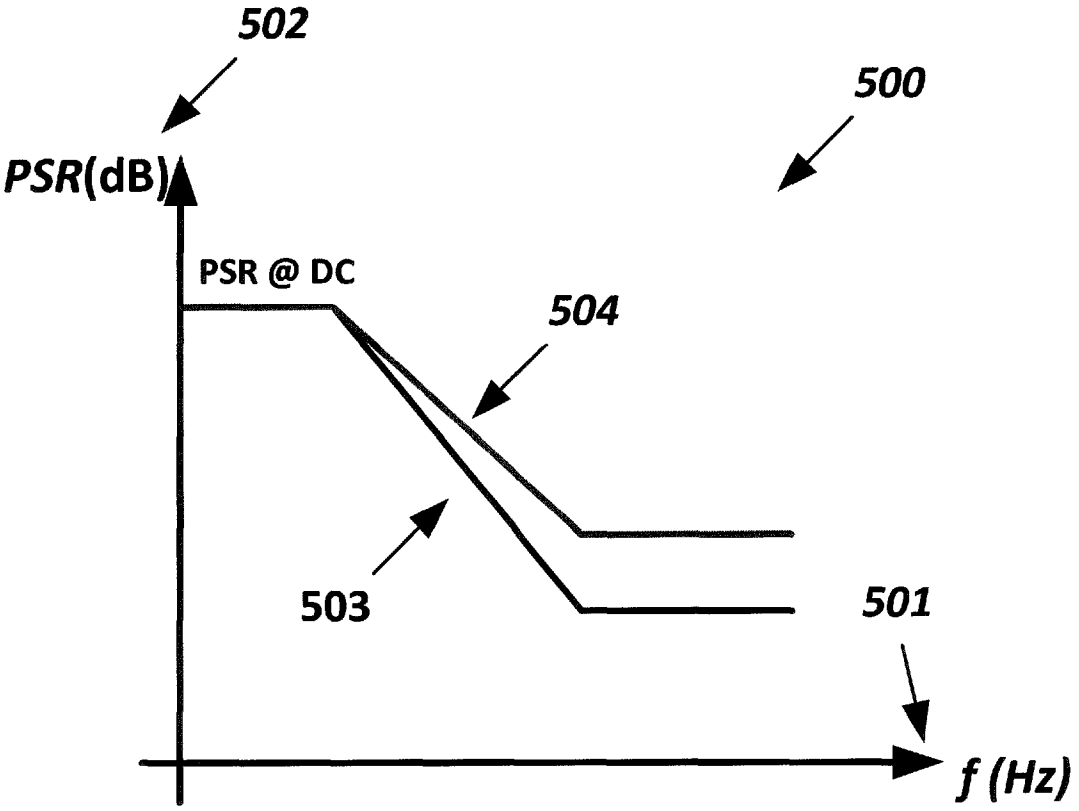
FIG. 5 shows the expected power supply rejection for a linear voltage regulator where the dominant pole is placed inside the regulator loop (with FF and without FF).

The power supply rejection profile versus frequency of a linear voltage regulator depends on the type of frequency compensation of the feedback loop. FIG. 5 shows a power supply rejection (502) curve versus frequency (501) for the case where dominant pole of the LVR is placed inside the feedback loop. The PSR with the FF path (504) is better than the PSR without using the FF path (503). The improvement depends on the matching between the feed-forward path transfer function $A_{FFP}(s)$ and the direct path transfer function $A_{DP}(s)$.

Figure 6:
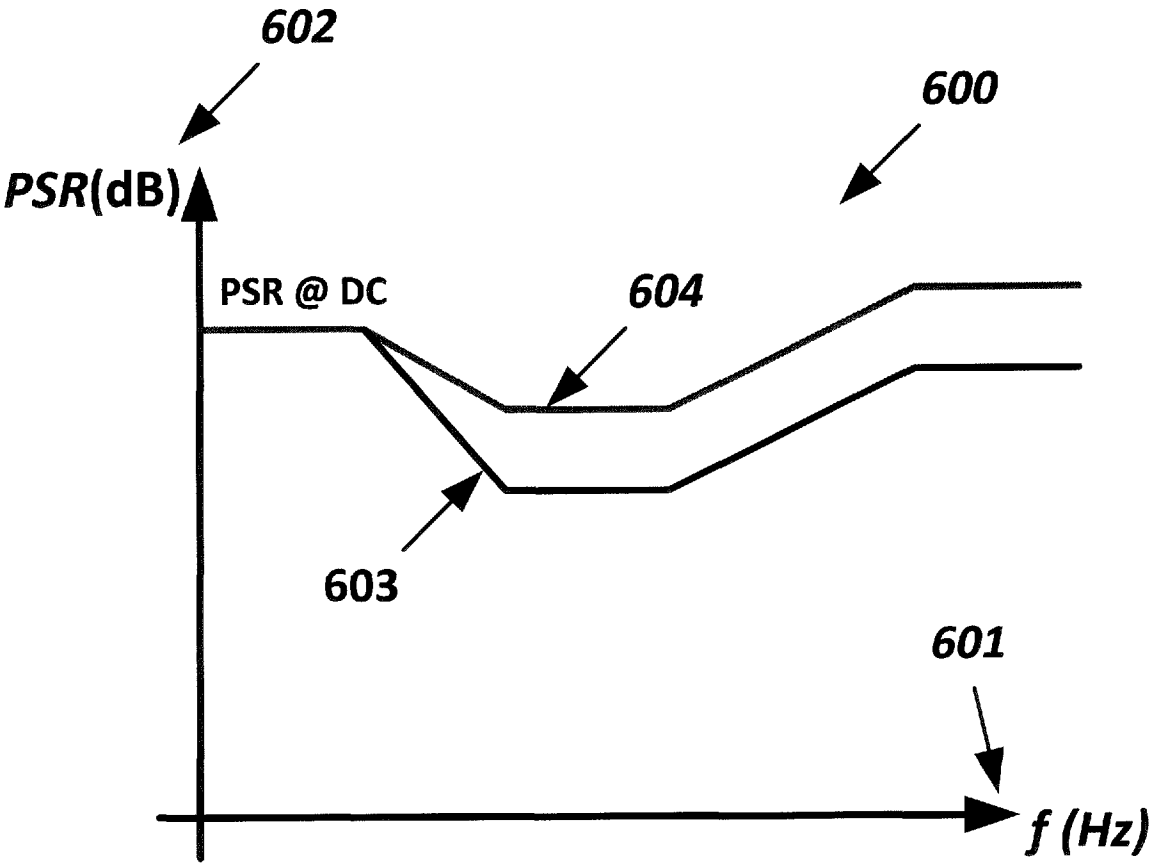
FIG. 6 shows the expected power supply rejection for a linear voltage regulator where the dominant pole is placed at the output node (with FF and without FF) in accordance with one embodiment of the invention.

FIG. 6 shows a power supply rejection (602) curve versus frequency (601) for the case where the dominant pole of the LVR is placed at the output of the voltage regulator. The PSR with the FF path (604) is better than the PSR without using the FF path (603). The improvement depends on the matching between the feed-forward path transfer function $A_{FFP}(s)$ and the direct path transfer function $A_{DP}(s)$.

In one or more embodiments of the invention, any resistive element in the passive FF block (205) can be implemented as either as a physical resistor or as a device emulating a resistive effect.

Figure 7:
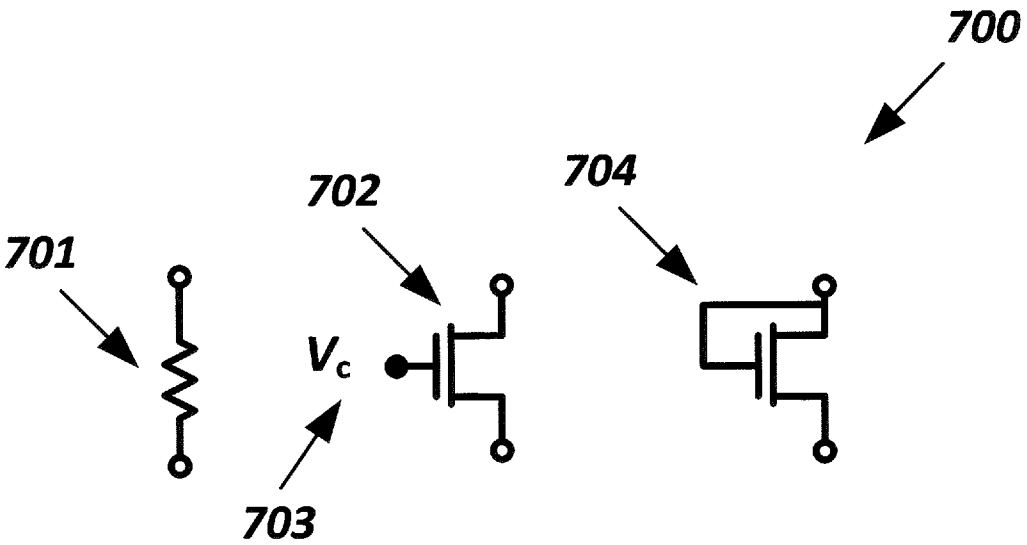
FIG. 7 shows different possible implementations of resistive elements in accordance with embodiments of the invention.

FIG. 7 shows three different exemplary implementations (700) of a resistive component, which may be a physical resistor (701), a transistor behaving as a resistor (702) whose resistance is controlled by a control voltage (703), or a diode connected device (704).

In one or more embodiments of the invention, any capacitive element in the passive FF block (205) can be implemented as a physical capacitor or as a device emulating as capacitive effect.

Figure 8:
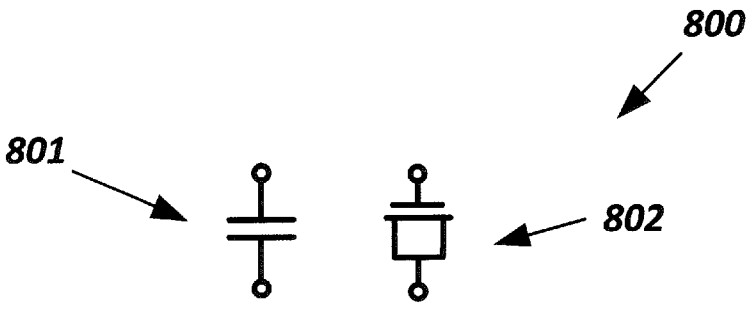
FIG. 8 shows different possible implementations of capacitive elements in accordance with embodiments of the invention.

FIG. 8 shows two different implementations of a capacitive component (800), which can be a physical capacitor (801) or a transistor acting as a capacitor (802).

In one or more embodiments, the components of the passive FF block can be programmable to track the input supply variations.

While embodiments of the invention have been illustrated with a limited number of examples. One skilled in the art would appreciate that other modification and variations are possible without departing from the scope of the invention. Therefore, the scope of the protection should be defined as in the included claims.

What is claimed is:

1. A low drop-out (LDO)/load switch linear voltage regulator (LVR) circuit having a first input terminal and a first output terminal, comprising:

a feedback network with a second input terminal connected to the first output terminal and a second output terminal;

a pass element having a third input terminal connected to the first input terminal, a third output terminal connected to the first output terminal and a first control terminal;

a combiner having a fifth input terminal connected to the second output terminal, a fourth input terminal connected to a fifth output terminal, and a fourth output terminal connected to the first control terminal; and a passive network with a sixth input terminal connected to the first input terminal, a seventh input terminal connected to a fixed voltage source and the fifth output terminal connected to the fourth input terminal, wherein a capacitor is connected between the sixth input terminal and the fifth output terminal, a resistor is connected between the sixth input terminal and the fifth output terminal, a second capacitor is connected between the fifth output terminal and the seventh input terminal, a second resistor is connected between the fifth output terminal and the seventh input terminal, the passive network comprising at least one inductor and the resistor in series.

2. The LVR circuit according to claim 1, wherein the passive network has at least one pole and one zero.

3. The LVR circuit according to claim 1, wherein the pass element is an n-type or a p-type device.

4. The LVR circuit according to claim 1, wherein the pass element comprises at least one selected from a group consisting of a field effect transistor, a bipolar junction transistor and a FinFET device.

5. The LVR circuit according to claim 1, wherein controller combines either currents or voltages.

6. The LVR circuit according to claim 1, wherein the passive network includes at least one selected from a group consisting of resistive components, capacitive components and inductive components.

7. The LVR circuit according to claim 6, wherein the values of the components are either fixed or input dependent.

8. The LVR circuit according to claim 6, wherein the resistive components are implemented using at least one element selected from a group consisting of a physical resistor and a transistor behaving as a resistor.

9. The LVR circuit according to claim 6, wherein the capacitive components are implemented using at least one element selected from a group consisting of a physical capacitor and a transistor operating as a capacitor.

* * * * *